United States Patent [19]

Wilson et al.

[11] Patent Number: 4,637,515

[45] Date of Patent: Jan. 20, 1987

[54] WRAP-AROUND CARRIER WITH IMPROVED HANDLE

[75] Inventors: Jerry F. Wilson, West Monroe; Richard L. Schuster, Monroe, both of La.

[73] Assignee: Manville Sales Corporation, Denver, Colo.

[21] Appl. No.: 788,353

[22] Filed: Oct. 17, 1985

[51] Int. Cl.[4] ..... B65D 75/00

[52] U.S. Cl. ..... 206/434; 206/141; 206/427; 229/52 B; 229/52 BC

[58] Field of Search ..... 206/141, 148, 162, 168, 206/175, 177, 199, 427, 434; 229/52 B, 52 BC, 40

[56] References Cited

U.S. PATENT DOCUMENTS

| | | | |
|---|---|---|---|
| 2,811,250 | 10/1957 | Arneson | 229/52 BC |
| 2,872,036 | 2/1959 | Forrer | 229/40 |
| 2,874,869 | 2/1959 | Hennessey | 229/40 |
| 3,112,856 | 12/1963 | MacIntosh et al. | 229/52 B |
| 3,371,846 | 3/1968 | Detzel | 229/52 B |
| 4,222,485 | 9/1980 | Focke | 229/52 B |
| 4,295,562 | 10/1981 | Wood | 206/427 |
| 4,314,634 | 2/1982 | Stone | 206/427 |
| 4,339,070 | 7/1982 | Davies | 229/52 B |
| 4,470,503 | 9/1984 | Stone | 229/52 B |
| 4,533,047 | 8/1985 | Calvert | 206/427 |
| 4,545,485 | 10/1985 | Oliff | 206/427 |

FOREIGN PATENT DOCUMENTS

| | | | |
|---|---|---|---|
| 1438035 | 6/1965 | France | 229/52 B |

*Primary Examiner*—William Price
*Assistant Examiner*—David T. Fidei
*Attorney, Agent, or Firm*—John D. Lister; Cornelius P. Quinn; Timothy R. Schulte

[57] ABSTRACT

A wrap-around article carrier with a handle portion bounded by spaced slits extending across the width of the top panel. The fingers and thumb are intended to be inserted beneath the slits. Upon lifting the carrier, the handle portion adjacent the slits folds upwardly about a score line in the handle portion, directing the stresses caused by the lifting force outwardly to the side panels. This arrangement makes it more convenient to lift the carrier and strengthens the handle portion.

15 Claims, 3 Drawing Figures

WRAP-AROUND CARRIER WITH IMPROVED HANDLE

FIELD OF THE INVENTION

This invention relates to a wrap-around article carrier, and more particularly to a wrap-around article carrier having an improved handle portion which has greater strength than the finger grips normally used in such carriers.

BACKGROUND OF THE INVENTION

One type of carrier for articles such as bottles and cans is formed from blanks of paperboard sheet stock which are wrapped around the articles by a packaging machine. Typically, the articles are encased by two side panels and top and bottom panels foldably connected to the side panels. The ends of the package are open. The package is adapted to be lifted by the thumb and finger through finger holes provided in the top panel. Openings are provided in the side panels adjacent the bottom panel to hold the heels or bases of the articles in place. In addition, where the articles are bottles, openings are provided in the top panel to hold the necks of the bottles in place.

One problem with such carriers is their vulnerability to tearing at the finger grips when the package is lifted by the thumb and finger due to the concentration of stress at these points. To combat this, the carriers typically are formed from relatively thick paperboard, having a caliper of 23 to 25 points (0.023"–0.025"). Although this material provides adequate tear resistance, it is recognized that if it were not for the tear stresses at the finger grips, thinner paperboard could be used. This would of course be a more economical construction and would be desirable to use if the problem of resisting tear stresses at the finger grips could be solved by other means.

In addition, although the design described above has been in use for quite some time, many people do not like having to lift a package only by their thumb and finger. It can be tiring over a period of time and is simply not as comfortable as lifting a package with one's entire hand would be. For this reason also it would be desirable to have a stronger, more convenient handle design for lifting a wrap-around carrier.

BRIEF SUMMARY OF THE INVENTION

This invention provides an improved handle design which solves the problems mentioned above. The top panel of the carrier contains a slit extending transversely of the length of the carrier, that is, transversely of the folds connecting the side panels to the top panel. In combination with a finger hole spaced from the slit, one can lift the carrier by the thumb and all the fingers, the thumb being inserted in the finger hole and the fingers in or underneath the slit. Preferably, two slits are provided so that either the thumb or the fingers can be inserted in either slit. The resulting handle can be further strengthened by a unique reinforcing fold arrangement that diverts the tear stresses out to the side of the package where the design can readily withstand them.

These design features can readily be implemented in the standard type of production blank from which the carrier is made, requiring only minor modifications to the blank forming die to provide for new slit and score lines.

Other features and aspects of the invention will be made clear, as well as the various benefits of the invention, in the more detailed description which follows.

DESCRIPTION OF THE INVENTION

Figure 1:
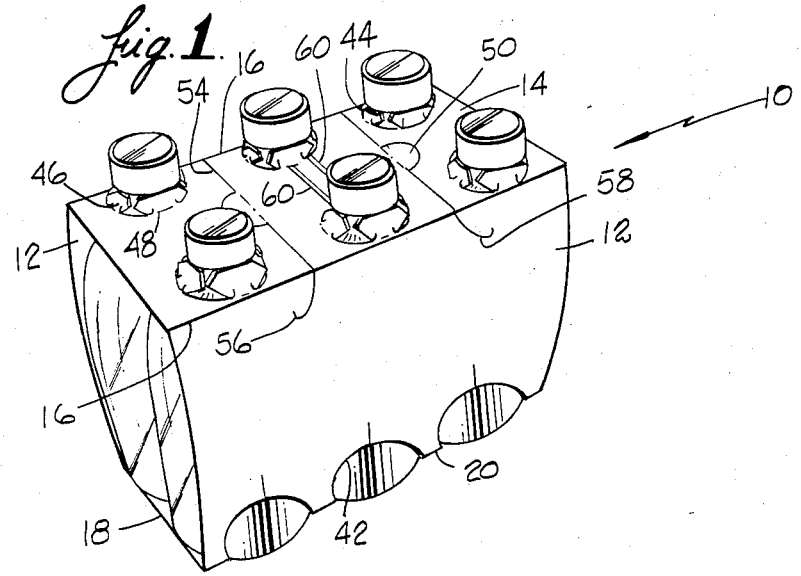
FIG. 1 is a pictorial representation of a wrap-around carrier of the present invention, shown containing six bottles, as it would appear prior to being picked up the consumer.
Figure 3:
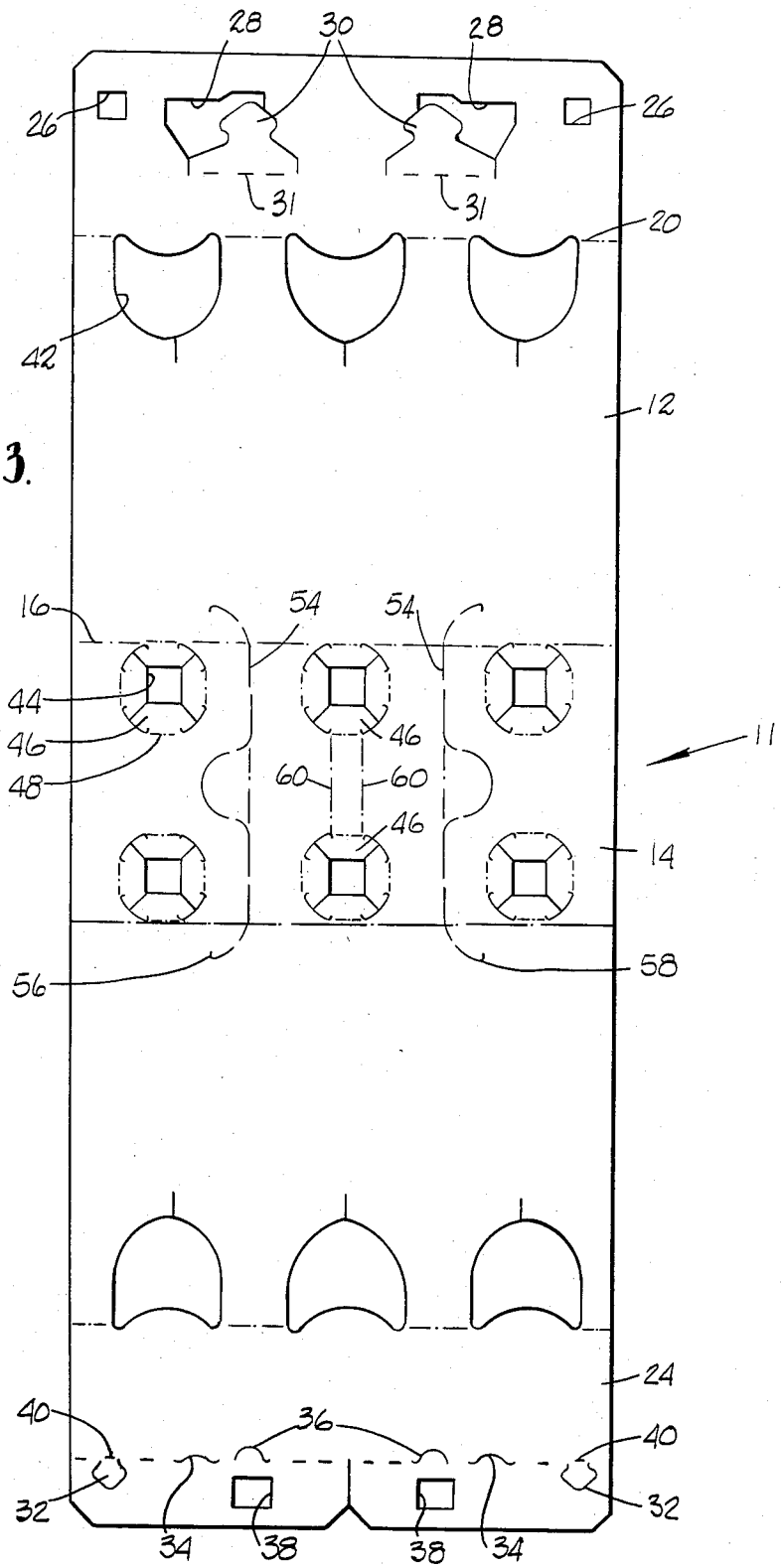
FIG. 3 is a plan view of a carrier blank for forming the carrier of the present invention.

Referring to FIG. 1, wrap-around carrier 10 comprises side panels 12 foldably connected to top panel 14 by folds 16 and to bottom panel 18 by folds 20. As shown in FIG. 3, the carrier is formed from a single blank 11 whose intermediate sections 12 and central section 14 correspond respectively to side panels 12 and top panel 14 of the carrier of FIG. 1. Score lines 16 of the blank correspond to folds 16 of the carrier, and score lines 20 of the blank correspond to folds 20 of the carrier.

The bottom panel 18 of the carrier is formed from blank end sections 22 and 24. The end section 22 is shown to have cutouts 26 and 28 and tabs 30 hingedly connected by score or fold lines 31. The other end section 24 has tabs 32, 34 and 36, and cutouts 38. Tabs 32 are hingedly connected by score or fold lines 40.

In forming the carrier the blank is folded downwardly on all score lines, as viewed in FIG. 3, so that end section 22 overlaps end section 24. End sections 22 and 24 are mechanically interlocked by the insertion of tabs 30 into cutouts 38, tabs 32 into cutouts 26 and tabs 34 and 36 into cutouts 28. These operations are all done by the automatic packaging machine designed to handle the particular type of blank being used and do not form a part of the present invention. Although the locking mechanism described results in a highly satisfactory bottom panel construction, enabling the bottom panel to be selectively locked in place by one or more of the tab and cutout mechanisms in order to accommodate different package perimeters, any arrangement for suitably forming a bottom panel from the end sections of a blank may be used. This invention, therefore, is not limited to any particular bottom panel design.

Still referring to FIGS. 1 and 3, cutouts 42, located adjacent score lines 20 in intermediate sections 12 of the blank 11, correspond to openings 42 in the side panels 12 of the carrier 10 through which the heels or bases of the bottles protrude. This common arrangement allows for slight variations in the final package dimensions and serves to hold the bases of the bottles in place. In addition, cutouts 44, located in central section 14 of the blank 11, correspond to openings 44 in the top panel 14 of the carrier 10 through which the necks of the bottles extend. Tabs 46, adapted to be bent upwardly about score lines 48, surround the neck holes 44 to complete the neck retainer structure. Although shown in some detail, the carrier construction described thus far is basically conventional in the art.

Spaced apart a distance to enable easy grasping by the thumb and middle finger are tabs 50, located in central section 14 of the blank 11 and in the top panel 14 of the carrier 10. As shown in FIG. 3, the tabs are connected to the carrier by score lines 52, enabling the finger and thumb to fold them down into the carrier about score lines 52. Aligned with score lines 52 are slits 54, which begin at the juncture of the tabs 50 and the score lines 52 and extend across the width of the top panel 14. Preferably, the slits 54 terminate in the upper part of side panels 12, as at 56, and are directed generally back toward the top panel at the point of termination to reduce the tendency of the stresses caused by lifting to tear the panel. This change in direction is produced by making the slit curved or arcuate in the side panel, as at 58, preferably so that the slits curve away from each other to minimize any tendency to tear. As will be seen, the portion of the top panel between the slits 54 becomes the handle portion of the carrier, allowing all four fingers of the hand to be inserted underneath either slit and the thumb to be inserted in the opposite thumb or finger hole.

Intermediate the handle portion a pair of parallel score lines 60 extend between opposite tabs 46 of the neck retainers in the handle portion. The purpose of score lines 60 is to enable the handle portion to bend upwardly about them to thus strengthen the handle and disperse the stresses to the side of the carrier instead of requiring the handle portion itself to take the full brunt of the lifting stresses. Preferably the score lines 60 terminate at the score lines 48 of the neck retainer tabs 46 to further increase the strength of the handle portion.

Figure 2:
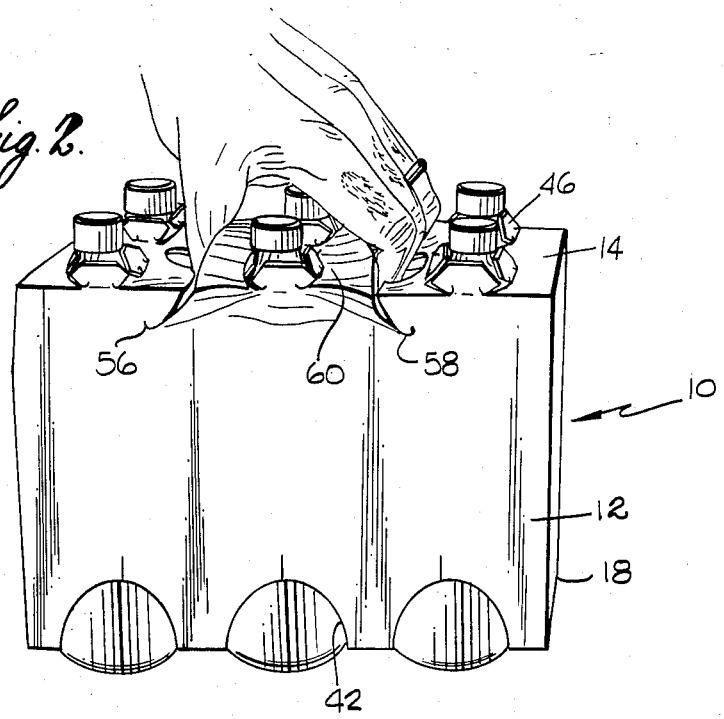
FIG. 2 is a pictorial representation of the carrier shown in FIG. 1 after it has been lifted.

Referring to FIGS. 1 and 2, the user simply pushes down on tabs 50 with thumb and finger, thereby bending them down about their score lines. The tabs fold in toward each other to make a double thick layer at this initial point at which the handle is grasped. Thus the tabs enhance the strength of the handle portion and also provide a cushion for the thumb and finger. The fold pressing against the thumb and finger is smooth and does not tend to cut as would the edge of a single layer of paperboard. At this point all the fingers can be inserted beneath the slit and the package can be lifted by the thumb and all the fingers, causing the handle portion to assume the shape shown in FIG. 2. Note that it tents up, that is, the portions of the handle adjacent the slits are lifted upwardly but the portions of the handle between the score lines 60 basically remain in their original position, thus tending to focus the lifting stresses to the fold lines 60 and to the portions of the fold lines 16 falling within the handle portion. As a result the finger holes are not the weak point, the stresses now being distributed over a much greater area.

As will now be appreciated, the handle portion of the carrier of the present invention has been greatly improved from the point of view of the consumer, who can now grasp and lift the package with the whole hand rather than just by the thumb and finger. It has also been greatly improved from the point of view of the producer who by merely redesigning the cut and score marks on the blank forming die can produce a carrier of such improved strength that it permits thinner, more economical paperboard to be used. For example, whereas paperboard having a caliper of 23 to 25 points has been commonly used in the prior art wrap-around carriers, paperboard having a caliper of only 20 points can readily be used in the carrier of this invention. Moreover, the use of still thinner stock, such as down to a caliper of 18 or so, is feasible.

It should be understood that the use of the term "score line" herein refers to a rupturing of the surface of the blank sheet material, resulting in a depression on one side of the sheet and a welt on the other, which allows the sheet to be folded on that line. It does not refer to a line which has been partially slit, which would weaken the fold.

It should be obvious that although a preferred embodiment of the invention has been described, changes to certain specific details can be made without departing from the spirit and scope of the invention as defined in the claims.

What is claimed is:

1. A wrap around article carrier, comprising:

a top panel, a bottom panel, side panels integral with and foldably connected to the top and bottom panels, the top panel containing two slits extending transversely of the folds connecting the side panels to the top panel, the slits extending across the width of the top panel and terminating in the side panels, the slits being spaced apart a distance permitting either the thumb or the fingers of a person lifting the carrier to be inserted in either slit, and the top panel containing at least one score line intermediate the slits and extending transversely of the folds connecting the side panels to the top panel, the portions of the top panel between the slits and the score line being adapted to fold upwardly about the score line when the carrier is lifted by the handle portion.

2. A wrap-around carrier according to claim 1, wherein the portions of the slits in the side panels contain an arcuate portion at least one point of which is located below the terminal point of the associated slit.

3. A wrap-around carrier according to claim 1, wherein each slit includes an opening extending away from the slit toward the end of the carrier, each opening being adapted to receive the thumb.

4. A wrap-around carrier according to claim 3, wherein the portions of the top panel which have been removed to form the thumb openings are foldably connected to the top panel at the slit and are adapted to be folded downwardly by the thumb and fingers when grasping the carrier to form a double thickness of panel material adjacent to and inwardly of the openings.

5. A wrap-around carrier according to claim 1, wherein the top panel contains two parallel score lines, the portions of the top panel between the slits and the score line nearest thereto being adapted to fold upwardly about said nearest score line when the carrier is lifted by the handle portion.

6. A wrap-around carrier according to claim 1, wherein the carrier contains openings in the top panel to receive the necks of bottles, each end of the score line terminating at a bottle neck opening.

7. A wrap-around carrier according to claim 5, wherein the carrier contains openings in the top panel to receive the necks of bottles, the ends of each score line terminating at a bottle neck opening.

8. A wrap-around carrier according to claim 5, wherein the ends of the parallel score lines are connected by score lines.

9. A production blank adapted to be folded to form a wrap-around article carrier, comprising:

sheet material in the general shape of a rectangle, the sheet having a central section intended to become the top panel of the carrier, end sections adapted to be connected together to form the bottom panel of the carrier, and intermediate sections connected to the central and end sections by score lines and intended to become the side panels of the carrier, the central section having spaced slits extending across the width of the central section of the blank and terminating in the intermediate sections of the blank, each slit being adapted to receive either the thumb or fingers of a person lifting a carrier formed from the blank, the central section containing at least one score line intermediate the slits and extending transversely of the score lines connecting the intermediate sections of the blank to the central section, the portions of the central section between the slits and the intermediate score line being adapted to fold upwardly about the intermediate score line when a carrier formed from the blank is lifted by the thumb and fingers from beneath the slits.

10. A production blank according to claim 9, wherein the portions of the slits located in the intermediate sections of the blank contain an arcuate portion at least a point of which is more remote from the central section than is the terminal point of the associated slit to reduce the tendency of the side panels of a carrier formed from the blank to tear at the ends of the slit upon the carrier being lifted.

11. A production blank according to claim 9 wherein the first and second slits have intermediate portions which extend outwardly toward the side edges ofthe blank, the intermediate portions being connected to the central section by score lines generally aligned with the remaining portions of the slits to form tabs in the top panel of a carrier formed from the blank, the tabs intended to be folded downwardly about the score lines by the thumb and finger.

12. A production blank according to claim 9, wherein the central section contains two parallel intermediate score lines, the portions of the central section between the slits and the intermediate score line nearest thereto being adapted to fold upwardly about said nearest intermediate score line when a carrier formed from the blank is lifted by the thumb and fingers from beneath the slits.

13. A production blank according to claim 9, wherein the central section contains openings for receiving the necks of bottles packaged in a carrier formed from the blank, each end of the score line intermediate the slits terminating at a bottle neck opening.

14. A production blank according to claim 12, wherein the central section contains openings for receiving the necks of bottles packaged in a carrier formed from the blank, the ends of the intermediate score lines terminating at a bottle neck opening.

15. A production blank according to claim 14, wherein the adjacent ends of the parallel score lines are connected by score lines.

* * * * *